US011939127B2

(12) United States Patent
Zimmer et al.

(10) Patent No.: US 11,939,127 B2
(45) Date of Patent: Mar. 26, 2024

(54) PALLET UNIT WITH CONTINUOUS WRAPPING SHEET EXTENDING WITHIN THE STACK OF BLOCKS AND PALLETIZING METHOD

(71) Applicant: SOCIETE DES PRODUITS NESTLE S.A., Vevey (CH)

(72) Inventors: Johannes Zimmer, Lausanne (CH); Julius Petrausch, Dortmund (DE)

(73) Assignee: Societe des Produits Nestle S.A., Vevey (CH)

( * ) Notice: Subject to any disclaimer, the term of this patent is extended or adjusted under 35 U.S.C. 154(b) by 0 days.

(21) Appl. No.: 17/632,614

(22) PCT Filed: Aug. 6, 2020

(86) PCT No.: PCT/EP2020/072095
§ 371 (c)(1),
(2) Date: Feb. 3, 2022

(87) PCT Pub. No.: WO2021/023806
PCT Pub. Date: Feb. 11, 2021

(65) Prior Publication Data

US 2022/0274752 A1 Sep. 1, 2022

(30) Foreign Application Priority Data

Aug. 6, 2019 (EP) ..... 19190239

(51) Int. Cl.
*B65D 71/00* (2006.01)
*B65B 11/00* (2006.01)
*B65B 35/50* (2006.01)

(52) U.S. Cl.
CPC ..... *B65D 71/0096* (2013.01); *B65B 11/004* (2013.01); *B65B 35/50* (2013.01);
(Continued)

(58) Field of Classification Search
CPC ..... B65D 2571/00061; B65D 2571/00049; B65D 71/0096
(Continued)

(56) References Cited

U.S. PATENT DOCUMENTS 3,695,426 A * 10/1972 Engelsberger ..... B65D 75/00 53/442
4,206,846 A * 6/1980 Connolly ..... B65B 11/045 383/117
(Continued)

FOREIGN PATENT DOCUMENTS

DE 8611708 6/1986
DE 9421187 7/1995
(Continued)

*Primary Examiner* — Jacob K Ackun
(74) *Attorney, Agent, or Firm* — K&L Gates LLP

(57) ABSTRACT

Pallet unit (1) for transporting objects comprising a pallet (10) and a stack (11) of object blocks (B1 . . . B5) arranged on the pallet (10). The pallet unit (1) comprises a wrapping sheet (12) having vertical portions (V1 . . . V12) and horizontal portions (h1 h15) covering parts of the blocks (B1 . . . B5), said wrapping sheet (12) being laid along a continuous path and extending at least partly within the stack (11). Method for palletizing object blocks using said pallet unit (1).

11 Claims, 5 Drawing Sheets

(52) U.S. Cl.
CPC ..... *B65D 2571/00049* (2013.01); *B65D 2571/00061* (2013.01)

(58) Field of Classification Search
USPC ..... 206/597
See application file for complete search history.

(56) References Cited

U.S. PATENT DOCUMENTS 4,386,704 A * 6/1983 Maillet ..... B21F 33/002 206/391
4,852,330 A * 8/1989 Carangelo ..... B65D 71/0096 53/399
5,269,645 A * 12/1993 Winski ..... B65G 59/005 156/562

FOREIGN PATENT DOCUMENTS

FR 2211923 7/1974
GB 1369587 10/1974

* cited by examiner

PALLET UNIT WITH CONTINUOUS WRAPPING SHEET EXTENDING WITHIN THE STACK OF BLOCKS AND PALLETIZING METHOD

CROSS REFERENCE TO RELATED APPLICATIONS

The present application is a National Stage of International Application No. PCT/EP2020/072095, filed on Aug. 6, 2020. which claims priority to European Patent Application No. 19190239.4, filed on Aug. 6, 2019, the entire contents of which are being incorporated herein by reference.

FIELD OF THE INVENTION

The present invention concerns a pallet unit for transporting objects and a method for palletizing object blocks.

BACKGROUND OF THE INVENTION

Pallets are conventionally used to support objects or goods in a stable manner and allow their handling and storage. Goods or packaging containers are in fact often placed on a pallet secured with shrink wrap and shipped. Goods contained in blocks, also called hereafter object blocks, are palletized with a specific palletization pattern. The object blocks form therefore a stack which is subsequently stretch-wrapped with a plastic film.

The word "block" shall be understood as one object or an assembly of objects forming a solid piece.

The blocks are particularly subjected to shearing due to the manipulation or to transport accelerations for instance. Said shearing can provoke an inclination of the pallet and therefore a sliding and damage of the goods.

For the transport of some goods such as plastic bottles of beverages, it is known to use pre-cut interleaved or sandwiched sheets placed horizontally between the blocks to protect the transported goods. The sandwiched sheets are usually made of paper-based material. While a palletization using said sandwiched sheets may enable an increase in the resistance against deformation or destruction of goods due to the weight of the blocks, shear strain produced in the pallet can neither be avoided nor limited with said palletization.

Moreover, the positioning of interlayers presents the drawback of using a significant amount of paper material.

The invention seeks to provide a pallet unit and a method for palletizing object blocks able to address at least one of the aforesaid drawbacks.

SUMMARY OF THE INVENTION

The invention concerns a pallet unit for transporting objects comprising a pallet and a stack of object blocks arranged on the pallet. According to the invention, the pallet unit comprises a wrapping sheet having vertical and horizontal portions covering parts of the blocks, said wrapping sheet being laid along a continuous path and extending at least partly within the stack.

The disposal of a continuous wrapping sheet having vertical and horizontal portions covering parts of the blocks makes it possible to reduce the shearing. Indeed, the continuity of the wrapping sheet makes it possible to have a strong connection between the blocks limiting thus shear movements. Moreover, covering the blocks with both horizontal and vertical portions enable an increase of the resistance in both horizontal and vertical directions.

Furthermore, using a continuous layer rather than pre-cut sandwiched sheets enables cost savings.

In one embodiment, every two of horizontal portions covering parts of a block are connected by a vertical portion of the wrapping sheet.

The blocks which are covered by both horizontal portions and a vertical portion are therefore well stabilized in both horizontal and vertical directions.

In one embodiment, part of the wrapping sheet is disposed outside the stack faces on external parts of the blocks. This will allow marketing to place advertisement on these specific location which also brings a certain advantage.

In one embodiment, a horizontal portion of the wrapping sheet extending between two blocks is folded onto itself.

Folding a horizontal portion onto itself enables on the one hand a better resistance in the horizontal direction and on the other hand eventually the rotation of the wrapping sheet in order to make the wrapping sheet change its extension directions.

In one embodiment, the stack comprises rows of horizontally adjacent blocks, a vertical portion of the wrapping sheet extending between every two horizontally adjacent blocks.

As the wrapping sheet separates vertically all the horizontally adjacent blocks, the vertical stability is highly enhanced.

In one embodiment, two vertical portions and two horizontal portions of the wrapping sheet cover at least one block, said two horizontal portions being connected by said two vertical portions.

The block is therefore perfectly stabilized in both horizontal and vertical directions.

In one embodiment, the stack comprises lower blocks, upper blocks and intermediate blocks, said intermediate blocks being arranged between lower blocks and upper blocks, two vertical portions and two horizontal portions of the wrapping sheet covering each of the lower blocks and each of the intermediate blocks.

The lower blocks and intermediate blocks are even more stabilized since two horizontal portions separate every two vertically adjacent blocks.

In one embodiment, the stack comprises rows of blocks having one or a plurality of horizontally adjacent blocks, at least one row of blocks being covered by two horizontal portions and one vertical portion connecting said two horizontal portions.

In one embodiment, the stack comprises lower blocks, upper blocks and intermediate blocks, said intermediate blocks being arranged between lower blocks and upper blocks, each block presenting a length different from a length of a vertically adjacent blocks, the length of each horizontal portion of the wrapping sheet covering an intermediate block being less than the length of the intermediate block said horizontal portion covers.

Less amount of wrapping sheet is used while ensuring a good stability of the stack.

The invention also concerns a method for palletizing object blocks using the pallet unit having at least part of the above-mentioned features, said method comprising the following steps:

Positioning a fraction of a row of blocks on the pallet;

Disposing the wrapping sheet to cover parts of the blocks;

Completing the rest of said row, said steps being repeated until the stack is completed.

In one embodiment, the method for palletizing object blocks using the pallet unit having at least part of the above-mentioned features comprises the following steps:

Positioning a row of blocks on the pallet;

Disposing the wrapping sheet to cover parts of the blocks;

said steps being repeated until the stack is completed.

In one embodiment, the method for palletizing object blocks using the pallet unit having at least part of the above-mentioned features comprises the following steps:

Positioning two fractions of two rows of blocks stacked together on the pallet;

Disposing the wrapping sheet to cover parts of the two fractions;

Completing said two rows of blocks with two other fractions stacked together;

Disposing the wrapping sheet to covert parts of said two other fractions, said steps being repeated until the stack is completed.

BRIEF DESCRIPTION OF THE DRAWINGS

Additional features and advantages of the present invention are described in, and will be apparent from, the description of the presently preferred embodiments which are set out below with reference to the drawings in which.

DETAILED DESCRIPTION OF THE INVENTION

Figure 1:
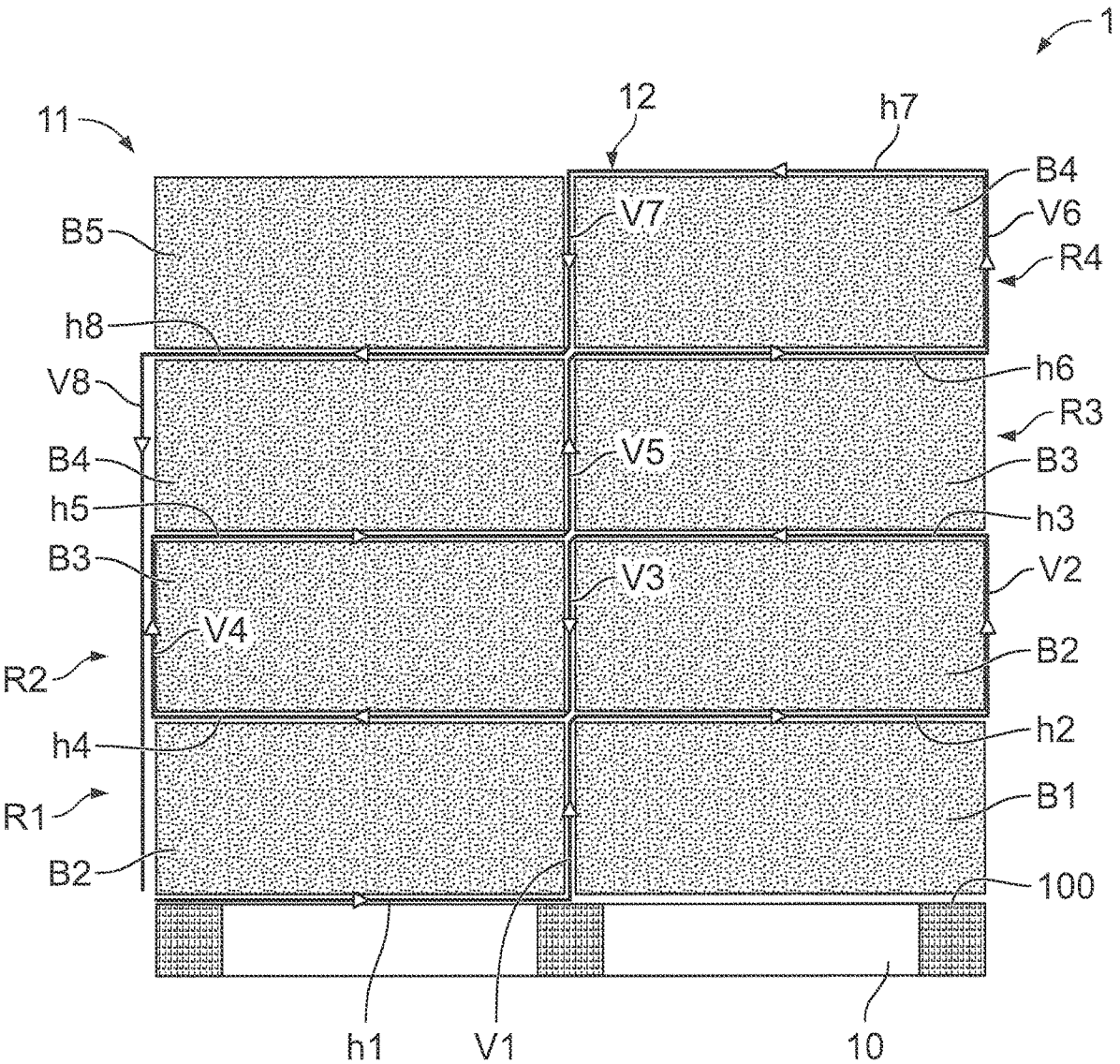
FIGS. 1 to 5 are schematic representations of a pallet unit according to five different embodiments of the invention.

FIGS. 1 to 5 illustrate schematically a pallet unit 1 according to five different embodiments of the invention.

The pallet unit 1 comprises a pallet 10, a stack 11 of object blocks Bi (here i=1 to 5) and a wrapping sheet 12.

The pallet 10 can be of any type of known pallets. Depending on the use made of it and more particularly of the stacked object blocks Bi, the pallet 10 can be made of wood, plastic, metal, paper, or recycled materials.

The pallet 10 comprises a storage surface 100 on which the stack 11 is arranged. The pallet 10 is designed to withstand the weight of the object blocks Bi stacked on said pallet 10.

The words "horizontal" and "vertical" are used in this document for simplicity sake. A horizontal plane shall refer to a plane parallel to the pallet 10, and in particular to the storage surface 100 and a horizontal direction as belonging to a horizontal plane. A vertical plane shall refer to a plane which is orthogonal to a horizontal plane, and a vertical direction as belonging to a vertical plane.

The object blocks Bi, or blocks Bi, can also be of any type. The object blocks Bi are for example goods which are stacked on the pallet 10 to enable their manipulation and transportation. The blocks Bi can comprise one or a plurality of objects. As an example, each block Bi can comprise three packs of water bottles, each pack comprising six bottles. In another example, depending on the size of the pack and on the size of the block, each block Bi can comprise 6 packs of water bottles, each pack comprising, 4, 6 or 8 bottles.

The stack 11 comprises rows Rj (here j=1 to 4) of blocks Bi. Each row Rj comprises one or a plurality of blocks Bi horizontally adjacent one to the other.

Horizontally adjacent blocks shall be understood here as horizontally neighboring blocks. Vertically adjacent blocks shall refer to two blocks stacked one on the other.

In the described embodiments, the stack 11 comprises four rows R1, R2, R3, R4. Each row Rj comprises two horizontally adjacent blocks. The stack 11 comprises eight blocks Bi. In this document, a block Bi is also sometimes referred to as the block Bi of Rj, i.e. the block Bi arranged on row Rj.

The blocks Bi are numbered in the order of palletization. In other words, B1 is (or are) the first block(s) arranged on the pallet 10, B2 is (or are) the second block(s) arranged on the pallet 10, etc. The stack 11 therefore comprises lower blocks, upper blocks and intermediate blocks, the intermediate blocks being arranged between lower blocks and upper blocks. The rows Rj are also numbered in the order of palletization which is from bottom to top.

For instance, in the embodiment of FIG. 1, the lower blocks are the blocks B1 and B2 of R1, and the upper blocks are the blocks B4 of R4 and B5. The intermediate blocks are the blocks B2, B3 of R2, B4 of R3.

The blocks Bi are schematically represented as having a parallelepiped shape. Each block Bi comprises here a front face, a rear face, two side faces, an upper face and a lower face. Each block Bi has a length, a depth and a height. The length of each block Bi shall refer to the distance between two side faces of the block. The depth shall refer to the distance between a front face and a rear face of the block length shall. The length and the height are horizontal dimensions when the pallet unit 10 is in its operating configuration, i.e. when the blocks Bi are stacked together on the pallet 10.

In the described embodiments, each block Bi comprises an internal side face and an external side face opposite to said internal side face. The internal side faces of the blocks Bi extend within the stack 11, or in other words the internal side faces of two horizontally adjacent blocks Bi are arranged one in front of the other.

The representation of the blocks Bi is only schematic and therefore the terminology in relation to the faces and the dimensions of the blocks is purely meant to simplify the comprehension of the invention. Moreover, the blocks Bi may of course present a different shape, such as a rounded shape.

In the embodiments represented on FIGS. 1 to 4, all the blocks Bi are similar, i.e. they present the same shape and dimensions.

Figure 5:
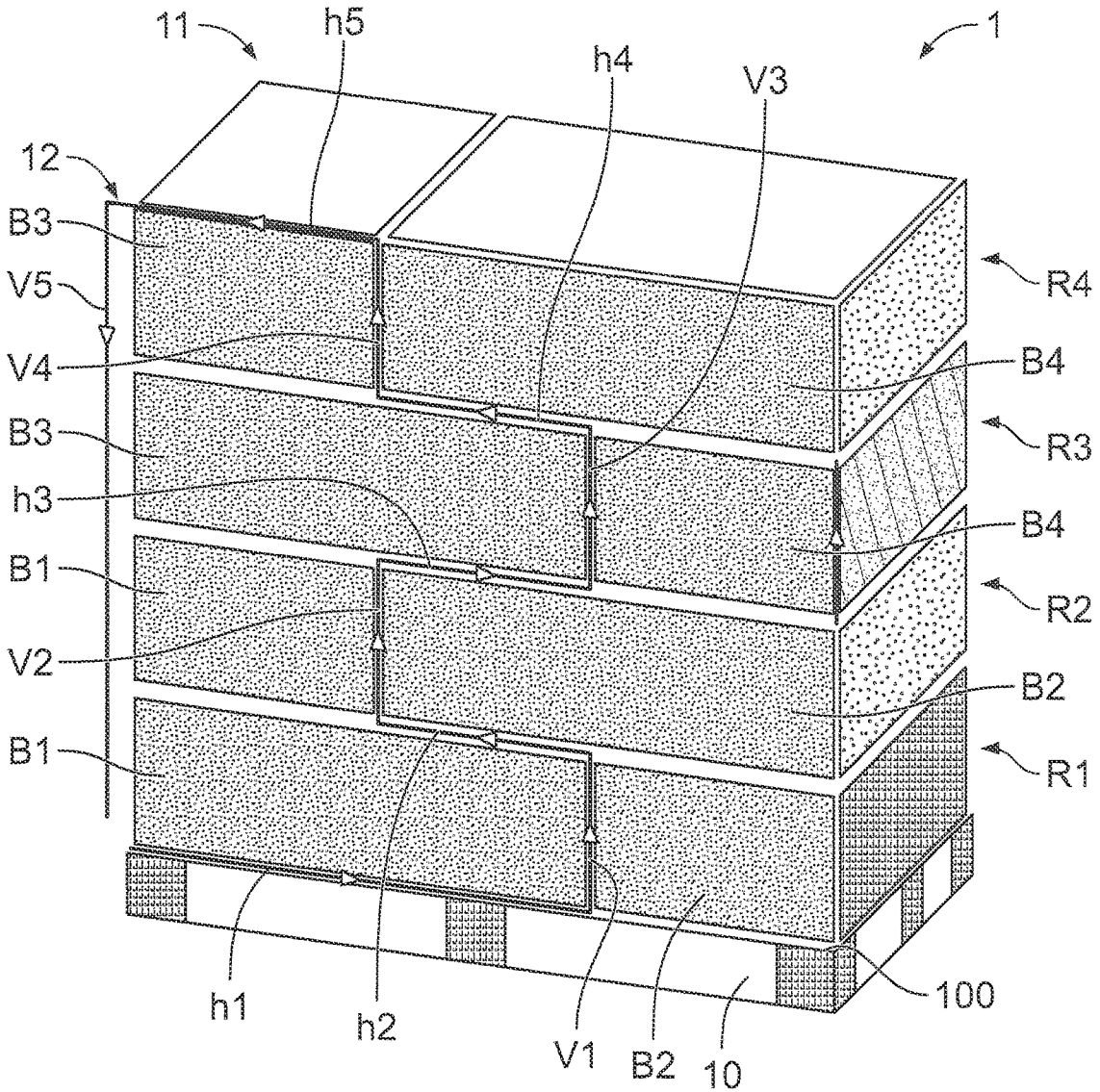

In the embodiment represented on FIG. 5, each block Bi presents a different length from its vertically adjacent block. Moreover, each block Bi presents a different length from its horizontally adjacent block. In this example, the horizontally adjacent block and the vertically adjacent block present the same length. All the rows Rj present the same length.

For instance, block B1 of R1 presents a length substantially equal to two-thirds of the length of R1, and its horizontally adjacent block B2 of R1 presents a length substantially equal to one third of a length of R1. The block B1 of R2, which is the vertically adjacent block of B1 of R1, presents a length substantially equal to one third of a length of R2, and the block B2 of R2 presents a length substantially equal to two-thirds of the length of R2.

The wrapping sheet 12 is laid along a continuous path and extends at least partly within the stack 11. The wrapping sheet 12 can be a reel which is unwounded during palletization of the blocks Bi.

The wrapping sheet 12 can be made of a thin cartoon material.

The disclosed embodiment uses a thin cartoon material as wrapping sheet. However, the material of the wrapping sheet can be of a wide range.

Any paper film, cellulose or lignin based film, plastic film (petroleum or bio-based) using any production process, e.g.

injection, extrusion, extrusion blow molding etc.), woven textile or long fibers film etc., can be used.

The main requirement is that it is a thin surface (either full or web) which is able to bend but has rigidity against extension.

For example, an appropriate material could be cellophane.

The wrapping sheet 12 can be made of a self-adhesive material.

The wrapping sheet 12 comprises vertical and horizontal portions covering parts of the blocks.

The verb "cover" shall be understood here as to extend on a part or surface. Therefore, the verb "cover" should not be limited to the definition of putting on the top of something. In other words, in the particular described examples, covering parts of a block Bi shall mean covering its front face and/or rear face and/or side faces and/or upper face and/or lower face.

In the first embodiment according to the invention represented in FIG. 1, the palletization of the pallet unit 1 is accomplished according to the following steps:

Positioning the block B1 on the pallet 10 such that only a fraction of the row R1 is arranged;

Disposing a horizontal portion h1 of the wrapping sheet 12, said horizontal portion h1 extending on a fraction of the storage surface 100 of the pallet 10 which is not covered by the block B1;

Covering the internal side face of the block B1 with a vertical portion v1 of the wrapping sheet 12;

Covering the upper face of the block B1 with a horizontal portion h2;

Positioning the block B2 of R1 on the pallet 10 such as to complete the row R1, and positioning the block B2 of R2 above the block B1, said block B2 of R2 forming a fraction of row R2;

Covering the external side face of the block B2 of R2 with a vertical portion v2 of the wrapping sheet 12;

Covering the upper face of the block B2 of row R2 with a horizontal portion h3;

Covering the internal side face of the block B2 of R2 with a vertical portion v3 of the wrapping sheet 12;

Covering the upper face of the block B2 of R1 with a horizontal portion h4 of the wrapping sheet 12;

Positioning the block B3 of R2 such as to complete the row R2, and positioning the block B3 of R3 above the block B2 of R2, said block B3 of R3 forming a fraction of row R3;

Covering the external side face of the block B3 of R2 with a vertical portion v4 of the wrapping sheet 12;

Covering the upper face of the block B3 of R2 with a horizontal portion h5;

Covering the internal side face of the block B3 of R3 with a vertical portion v5 of the wrapping sheet 12;

Covering the upper face of the block B3 of row R3 with a horizontal portion h6;

Positioning the block B4 of R3 such as to complete the row R3, and positioning the block B4 of R4 above the block B3 of R3, said block B4 of R4 forming a fraction of row R4;

Covering the external side face of the block B4 of R4 with a vertical portion v6 of the wrapping sheet 12;

Covering the upper face of the block B4 of R4 with a horizontal portion h7;

Covering the internal side face of the block B4 of R4 with a vertical portion v7 of the wrapping sheet 12;

Covering the upper face of the block B4 of R3 with a horizontal portion h8 of the wrapping sheet 12;

Covering the external side faces of the blocks B4 of R3, B3 of R2 and B2 of R1 with a vertical portion v8 of the wrapping sheet 12; and Positioning the block B5 of R4 horizontally adjacent to the block B4 of R4 such as to complete the row R4.

Once the wrapping sheet is in place and the pallet completed with the blocks, the pallet may be surrounded with a film (plastic film or other type of film) in order that the blocks are held in place on the pallet.

In the first embodiment, a vertical portion of the wrapping sheet 12 extends between each two horizontally adjacent blocks Bi. In particular, the horizontally adjacent blocks Bi, here two blocks of the same row Rj, are separated by a vertical portion of the wrapping sheet 12. In other words, a vertical portion of the wrapping sheet covers on both sides two internal side faces of two horizontally adjacent blocks. More precisely, the vertical portion v1 extends between the blocks B1 and B2 of R1, the vertical portion v3 extends between the blocks B2 and B3 of R2, the vertical portion v5 extends between the blocks B3 and B4 of R3, vertical portion v7 extends between the blocks B4 and B5 of R4.

Positioning a vertical portion of the wrapping sheet 12 between the horizontally adjacent blocks enable a good stabilization of the blocks in the vertical direction.

Moreover, in this first embodiment, all the blocks apart from the lower block B1 of R1 and the upper block B5 of R4, are covered by two horizontal portions h1 to h8. In particular, the blocks B2, B3, B4 are covered by a horizontal portion at their lower face and by a horizontal portion are their upper face. Therefore, the blocks B2, B3, B4 are covered by two horizontal portions but also by the vertical portion which separates each block from its horizontally adjacent block. In other words, the two horizontal portions covering each of the blocks B2, B3, B4 are connected by a vertical portion of the wrapping sheet 12.

Covering the blocks with two horizontal portions and a vertical portion enables a good stability of the blocks in both vertical and horizontal directions.

Some blocks of this first embodiment are covered by two horizontal portions and two vertical portions. In particular, each of the upper face and the lower face of said blocks is covered by a horizontal portion, and each of the side faces of said blocks is covered by a vertical portion. In particular, the blocks B2, B3 of R2, B4 are covered by two horizontal portions and two vertical portions. Said blocks are therefore perfectly stabilized in both vertical and horizontal directions.

Figure 2:
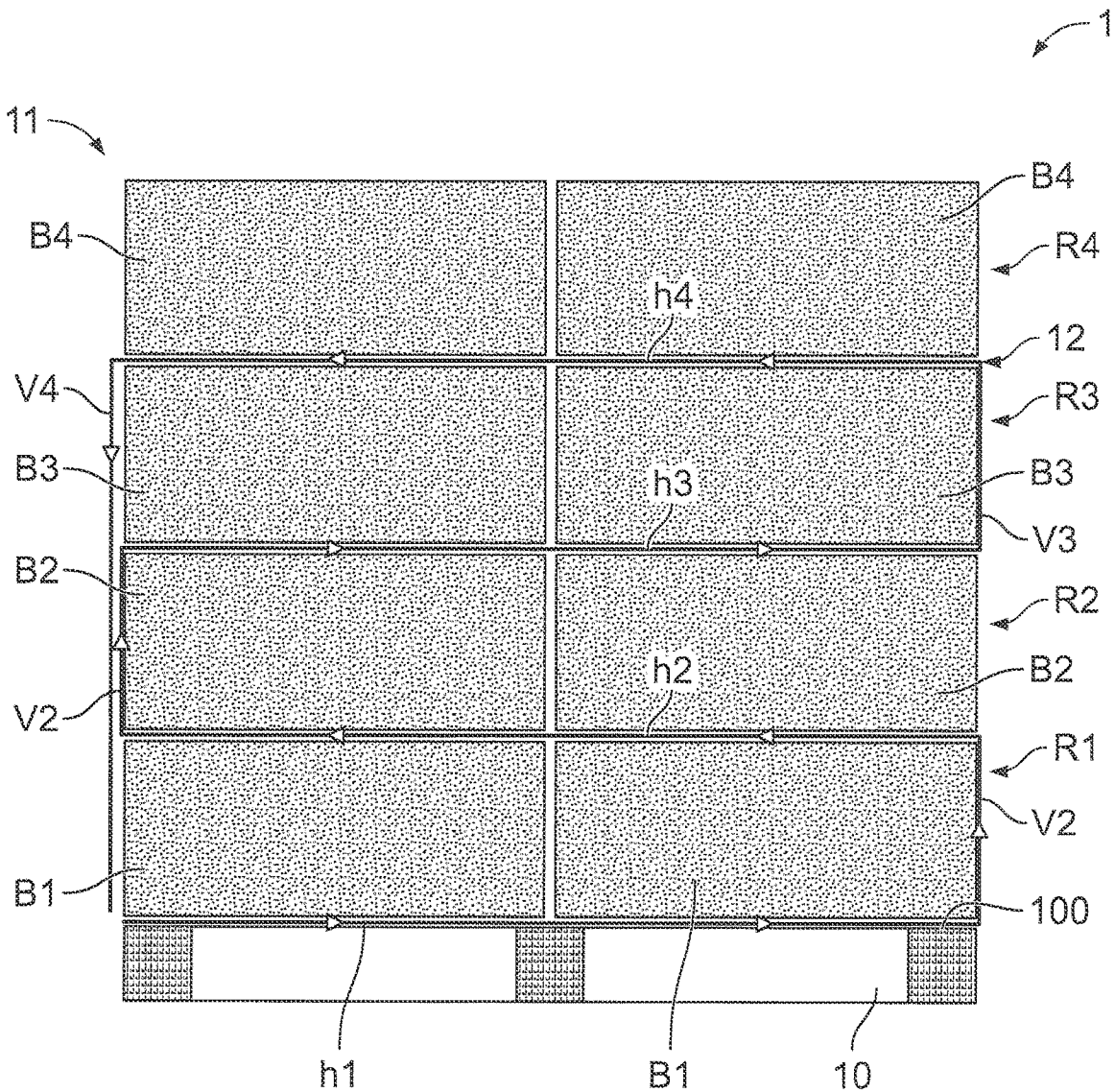

The palletization according to the second embodiment of FIG. 2 differs mainly from that of the first embodiment by the fact that no vertical portion separates the horizontally adjacent blocks of the same row. In the second embodiment, at least one row of blocks is covered by two horizontal portions and one vertical portion. In particular, each of the rows R1, R2, R3 is covered by two horizontal portions and one vertical portion. In other words, one horizontal portion covers each of the lower faces and the upper faces of the blocks of the rows R1, R2, R3, and a vertical portion covers a side face of a block of each row. The horizontal portions h1 to h4 covering each of the rows R1, R2, R3 are linked by a vertical portion v1 to v4.

The palletization of the pallet unit 1 is therefore accomplished following the steps hereafter:

Covering at least partially the support surface 100 of the pallet 10 with a horizontal portion h1;

Positioning the row R1 on said horizontal portion h1, in this example positioning the two horizontally adjacent blocks B1;

Covering the side face of one of the blocks 31 with a vertical portion v1;

Covering the upper face of the blocks 31 of R1 with a horizontal portion h2;

Positioning the row R2, in this example the two horizontally adjacent blocks B2, on the row R1 covered by the horizontal portion h2;

Covering the side face of one of the blocks B2 with a vertical portion v2;

Covering the upper face of the blocks B2 of R2 with a horizontal portion h3;

Positioning the row R3, in this example the two horizontally adjacent blocks B3, on the row R2 covered by the horizontal portion h3;

Covering the side face of one of the blocks B3 of R3 with a vertical portion v3;

Covering the upper face of the blocks B3 of R3 with a horizontal portion h4;

Covering the side face of each of row R3, R2, R1 with a vertical portion v4;

Positioning the row R4, in this example the two horizontally adjacent blocks B4, on the row R3 covered by the horizontal portion h4.

The disposing of a vertical portion connecting two horizontal portions covering each row enable the stabilization of the blocks in both vertical and horizontal directions.

The vertical portions extend alternatively in two distinct substantially parallel planes. The stability in vertical direction is therefore always ensured.

As each row is completely arranged on the pallet before or after positioning the wrapping sheet, the palletization of the pallet unit is quick.

Figure 3:
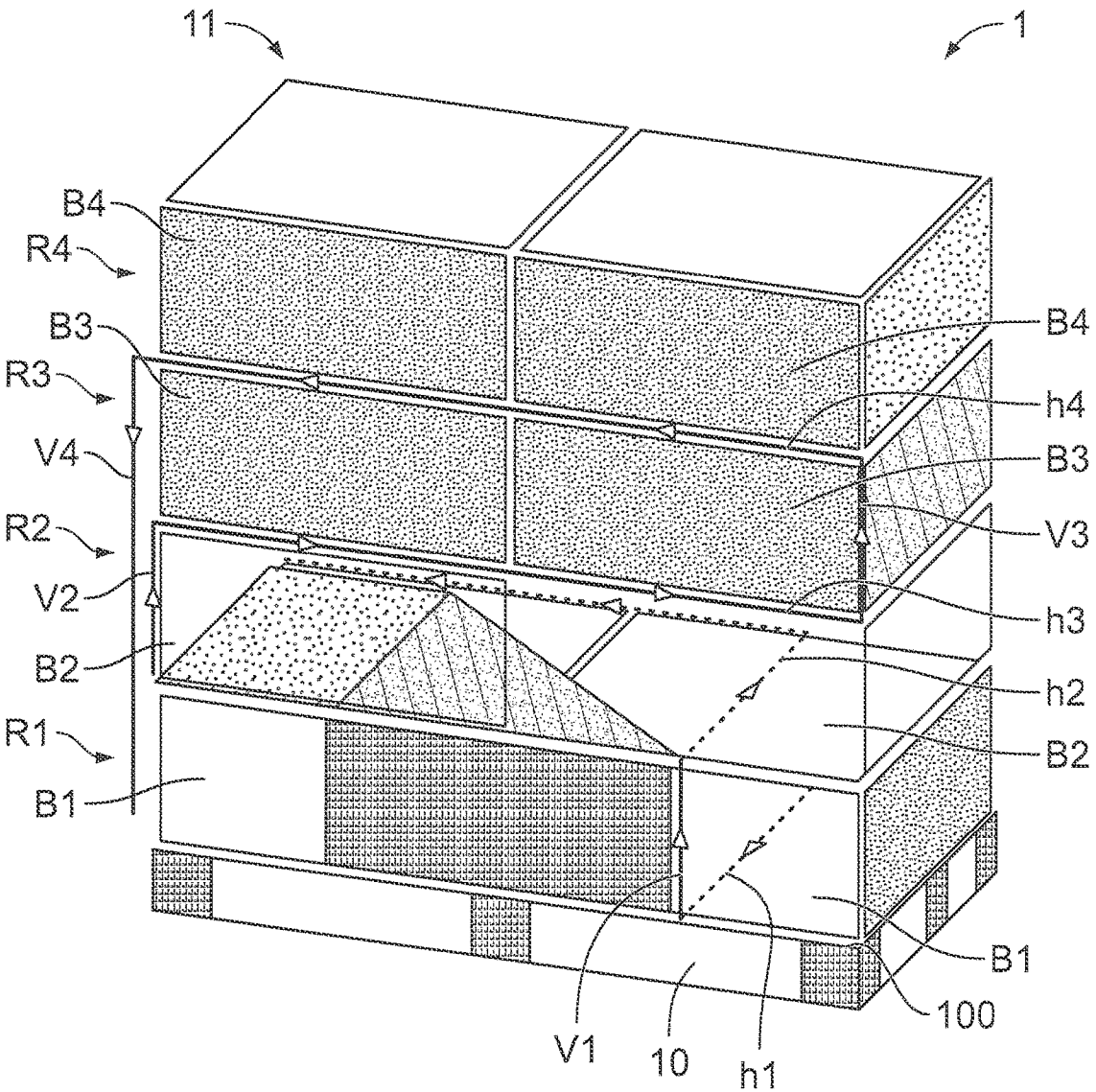

The palletization method according to the third embodiment of FIG. 3 is similar to the second embodiment in that all the rows apart from the superior row are covered by two horizontal portions and a vertical portion.

In the third embodiment, a horizontal portion covering a row of blocks is fold onto itself. In other words, during the palletization said horizontal portion of the wrapping sheet 12 covers a row Rj of blocks, then said horizontal portion is folded onto itself. Next, a vertical portion covers a face of a row Rj+1 stacked above said row Rj of blocks.

More precisely, the horizontal portion h2 covers the upper faces of row R1 by extending depthwise. The horizontal portion h2 is then folded onto itself. Said horizontal portion h2 forms here an isosceles right-angled triangle when it is folded onto itself. The vertical portion v3 covers then a side face of the row R3. Forming an isosceles right-angled triangle when folding the horizontal portion h2 enables the cover of the side face rather than the front face of the row R3. In other words, folding the horizontal portion h2 in this fashion enables the round and change of direction of the wrapping sheet 12.

Furthermore, the horizontal portions h1, h2 extend here depthwise while the horizontal portions h3, h4 extend lengthwise. This enables the alternation between covering front faces of some blocks, for instance B1, and side faces of other blocks, for instance B3.

The stability of the blocks thanks to this embodiment is therefore also improved in both horizontal and vertical directions, and the shearing is reduced. Folding a horizontal portion creates a double layer which improves the resistance in horizontal direction.

Figure 4:
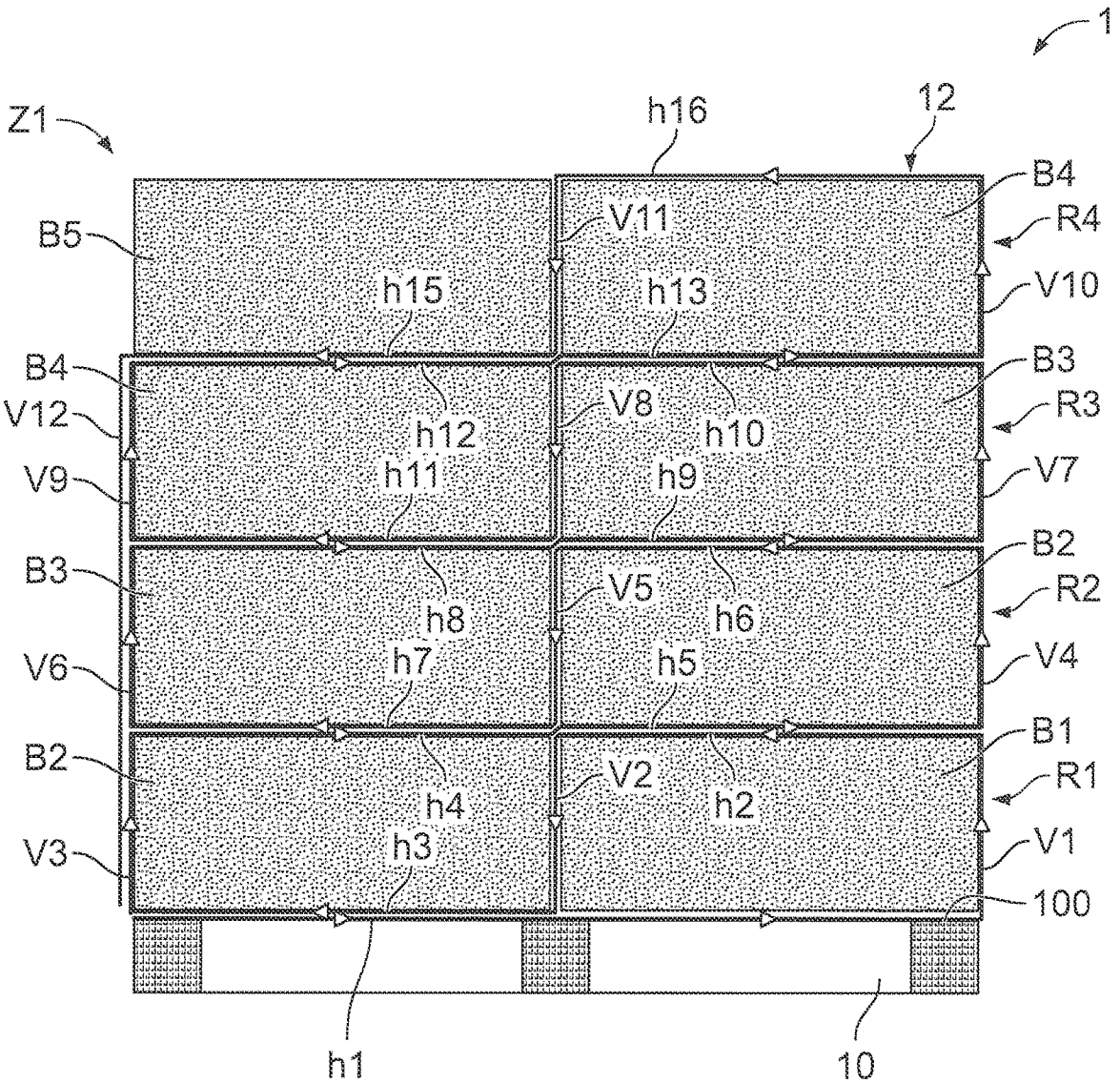

The palletization method according to the fourth embodiment of FIG. 4 is similar to the first embodiment in that a vertical portion of the wrapping sheet 12 extends between every two horizontally adjacent blocks.

Moreover, the order of positioning the blocks Bi on the pallet 10 is the same as in the first embodiment. In other words, a fraction of a row of blocks on the pallet, the wrapping sheet is disposed in order to cover parts of the blocks, the rest of said row is completed, and these steps are repeated until the stack 11 is completed.

The fourth embodiment differs however from the first embodiment as all the blocks apart from the block B5 of R4, are each covered by two horizontal portions and two vertical portions. The block B5 of R4 is covered by a horizontal portion and a vertical portion.

The stability of the blocks Bi is highly improved since almost all the blocks are stabilized on both sides in both horizontal and vertical directions.

The palletization method according to the fifth embodiment of FIG. 5 is similar to the first embodiment in that a vertical portion of the wrapping sheet 12 extends between every two horizontally adjacent blocks.

In the fifth embodiment, the length of each horizontal portion of the wrapping sheet 12 covering an intermediate block is inferior to the length of the intermediate block said horizontal portion is covering. This enabled by the fact that each block presents different a length from the length of its vertically adjacent block.

The pallet unit is therefore accomplished following the steps hereafter:

covering part of the support surface 100 of the pallet 10 with a horizontal portion h1;

positioning the blocks B1 of R1 and R2 one above the other and such that the block B1 of R1 is covered by the horizontal portion h1, said blocks B1 of R1 and R2 constitute here two respective fractions of rows R1 and R2;

covering the internal side face of the block B1 of R1 with a vertical portion v1;

covering part of the upper face of the block B1 of R1 with a horizontal portion h2;

covering the internal side face of the block B1 of R2 with a vertical portion v2;

positioning the blocks B2 of R1 and R2 one above the other and so as to complete the rows R1 and R2;

covering part of the upper face of the block B2 of R2 with a horizontal portion h3;

positioning the blocks B3 of R3 and R4 one above the other and above the block B1 of R2, said blocks B3 of R3 and R4 constituting fractions of the rows R3 and R4;

covering the internal side face of the block B3 of R3 with a vertical portion v3;

covering part of the upper face of the block B3 of R3 with a horizontal portion h4;

covering the internal side face of the block B3 of R4 with a vertical portion v4;

positioning the blocks B4 of R3 and R4 one above the other and so as to complete the rows R3 and R4;

covering the upper face of the block B3 of R4 with a horizontal portion h5;

a vertical portion v5 covering the external side face of each of the blocks B3 of R4, B3 of R3, B1 of R2 and B1 of R1.

This fifth embodiment enables also the reduction of the use of material for the wrapping sheet 12. Indeed, as the blocks present different dimensions, the horizontal portions can cover only part of each of the intermediate blocks. A cost reduction in the used material for the wrapping sheet is therefore possible.

The palletization process differs from an embodiment to the other. However, in all the described embodiments the wrapping sheet 12 is laid along a continuous path and presents vertical and horizontal portions.

The wrapping sheet 12 when extending vertically, changes its direction of extension from vertical direction to horizontal direction at each corner of a block Bi. In other words, the height of each vertical portion of the wrapping sheet 12 is equal to the height of the block, said vertical portion is covers. Therefore, when the height the blocks and/or the height of a row is adaptable, the height of the vertical portions can be chosen so as to enable a good stabilization of the blocks and prevent shearing. In other words, the wrapping sheet 12 is laid along a path which changes its direction from a vertical direction to a horizontal direction such that vertical portions present a height which is always inferior to a predefined height. The predefined height can be calculated such as to permit the prevention of shearing.

It should be understood that various changes and modifications to the presently preferred embodiments described herein will be apparent to those skilled in the art. Such changes and modifications can be made without departing from the spirit and scope of the present invention and without diminishing its attendant advantages. It is therefore intended that such changes and modifications be covered by the appended claims.

The different embodiments presented can be for example combined.

The schematic figures represent with arrows the direction or sense of the extension of the wrapping sheet 12, for example from right to left. Of course, said direction may be changed.

The palletization according to the described embodiments enables the reduction of shearing. Indeed, a good cohesion between the blocks is ensured by the continuity of the wrapping sheet covering parts of the blocks and a good stability in both directions is ensured by the presence of both horizontal and vertical portions of said wrapping sheet. In some embodiments, disposing a vertical portion of the wrapping sheet between every two horizontally adjacent blocks improves even more the vertical stability of the stack.

The invention claimed is:

1. A method for palletizing object blocks using a pallet, the method comprising the following steps:

Positioning a fraction of a row of blocks in a stack on the pallet;

Disposing a wrapping sheet to cover parts of the blocks; and

Completing the rest of the row, and the steps being repeated until the stack is completed, wherein the stack has a configuration selected from the group consisting of (i) the stack comprises rows of horizontally adjacent blocks, a vertical portion of the wrapping sheet extending between every two horizontally adjacent blocks, and (ii) the stack comprises rows of blocks having one or a plurality of horizontally adjacent blocks, at least one row of blocks being covered by two horizontal portions of the wrapping sheet and one vertical portion of the wrapping sheet connecting the two horizontal portions of the wrapping sheet.

2. The method of claim 1, wherein the wrapping sheet has vertical portions and horizontal portions covering the parts of the blocks, and the wrapping sheet is disposed along a continuous path and extending at least partly within the stack.

3. The method of claim 2, wherein every two of the horizontal portions of the wrapping sheet covering the parts of one of the blocks are connected by one of the vertical portions of the wrapping sheet.

4. The method of claim 1, wherein a portion of the wrapping sheet is disposed outside faces of external parts of the blocks.

5. The method of claim 1, wherein a horizontal portion of the wrapping sheet extending between two of the blocks is folded onto itself.

6. The method of claim 1, wherein the stack comprises rows of horizontally adjacent blocks, and a vertical portion of the wrapping sheet extends between every two of the horizontally adjacent blocks.

7. The method of claim 1, wherein two vertical portions and two horizontal portions of the wrapping sheet cover at least one of the blocks, and the two horizontal portions are connected by the two vertical portions.

8. The method of claim 1, wherein the stack comprises lower blocks, upper blocks and intermediate blocks, the intermediate blocks being arranged between the lower blocks and the upper blocks, wherein two vertical portions and two horizontal portions of the wrapping sheet cover each of the lower blocks and each of the intermediate blocks.

9. The method of claim 1, wherein the stack comprises rows of the blocks having one or a plurality of horizontally adjacent blocks, at least one of the rows of the blocks being covered by two horizontal portions of the wrapping sheet and one vertical portion of the wrapping sheet connecting the two horizontal portions.

10. The method of claim 1, wherein the stack comprises lower blocks, upper blocks and intermediate blocks, the intermediate blocks being arranged between lower blocks and upper blocks, and wherein each block presents a length different from a length of a vertically adjacent blocks, the length of each horizontal portion of the wrapping sheet covering an intermediate block being less than the length of the intermediate block the horizontal portion covers.

11. A method for palletizing object blocks using a pallet, the method comprising the following steps:

Positioning two fractions of two rows of blocks stacked together in a stack on the pallet;

Disposing a wrapping sheet to cover parts of the two fractions;

Completing the two rows of blocks with two other fractions stacked together; and Disposing the wrapping sheet to cover parts of the two other fractions, the steps being repeated until the stack is completed, wherein the stack has a configuration selected from the group consisting of (i) the stack comprises rows of horizontally adjacent blocks, a vertical portion of the wrapping sheet extending between every two horizontally adjacent blocks, and (ii) the stack comprises rows of blocks having one or a plurality of horizontally adjacent blocks, at least one row of blocks being covered by two horizontal portions of the wrapping sheet and one vertical portion of the wrapping sheet connecting the two horizontal portions of the wrapping sheet.

* * * * *